US005097873A

United States Patent [19]

Müller et al.

[11] Patent Number: 5,097,873

[45] Date of Patent: Mar. 24, 1992

[54] GRIPPER LOOM WITH A FLEXIBLE FITTING THREAD INSERTION BAND

[75] Inventors: Jakob Müller, Stanstad; Francisco Speich, Gipf-Oberfrick, both of Switzerland; Erich Bühler, Rheinfelden, Fed. Rep. of Germany

[73] Assignee: Textilma AG, Hergiswil, Switzerland

[21] Appl. No.: 582,983

[22] PCT Filed: Mar. 23, 1988

[86] PCT No.: PCT/CH88/00064

§ 371 Date: Nov. 30, 1988

§ 102(e) Date: Nov. 30, 1988

[87] PCT Pub. No.: WO88/07600

PCT Pub. Date: Oct. 6, 1988

Related U.S. Application Data

[63] Continuation of Ser. No. 295,608, Nov. 30, 1988, abandoned.

[30] Foreign Application Priority Data

Apr. 3, 1987 [CH] Switzerland ..... 1296/87
Oct. 2, 1987 [CH] Switzerland ..... 3847/87

[51] Int. Cl.[5] ..... D03D 47/12; D03D 47/27
[52] U.S. Cl. ..... 139/449
[58] Field of Search ..... 139/4.49, 443–446

[56] References Cited

U.S. PATENT DOCUMENTS 2,641,285 6/1953 Flamand .
3,159,184 12/1964 Brown, Jr. et al. .
3,175,587 3/1965 Gove, Jr. et al. ..... 139/449

FOREIGN PATENT DOCUMENTS 95137 11/1983 European Pat. Off. .
126497 11/1984 European Pat. Off. .
638633 11/1936 Fed. Rep. of Germany .
54956 3/1967 Fed. Rep. of Germany .
1804973 5/1970 Fed. Rep. of Germany .
2438717 2/1975 Fed. Rep. of Germany .
642408 4/1984 Fed. Rep. of Germany .
2240971 3/1975 France .
2514379 10/1982 France .
652764 11/1985 Switzerland .
2039303 8/1980 United Kingdom .

OTHER PUBLICATIONS

Prestel, K.: Unter: Untersuchungen an Webmaschinen Deutsche Textiltechnik 17 (1967), vol. 5, p. 289.

*Primary Examiner*—Andrew M. Falik
*Attorney, Agent, or Firm*—Toren, McGeady & Associates

[57] ABSTRACT

A gripper loom with at least one filling thread insertion device, including a perforated flexible insertion band, which carries a gripper head at one end and which is advanced into and again retracted from a shed by an alternatingly driven drive wheel. The drive wheel has teeth distributed across the circumference which engage into perforations of the insertion band. Furthermore, a guide member is assigned to the drive wheel near the gripper head so as to prevent the insertion band from lifting off the circumference of the drive wheel, and an end of the band facing away from the gripper head is fastened at a rotary guidance apparatus arranged with respect to the drive wheel so that the band end describes an at least approximate circular guide path during an entire reciprocating motion, the radius of the path being larger than the radius of the drive wheel.

30 Claims, 6 Drawing Sheets

GRIPPER LOOM WITH A FLEXIBLE FITTING THREAD INSERTION BAND

Figure 1:
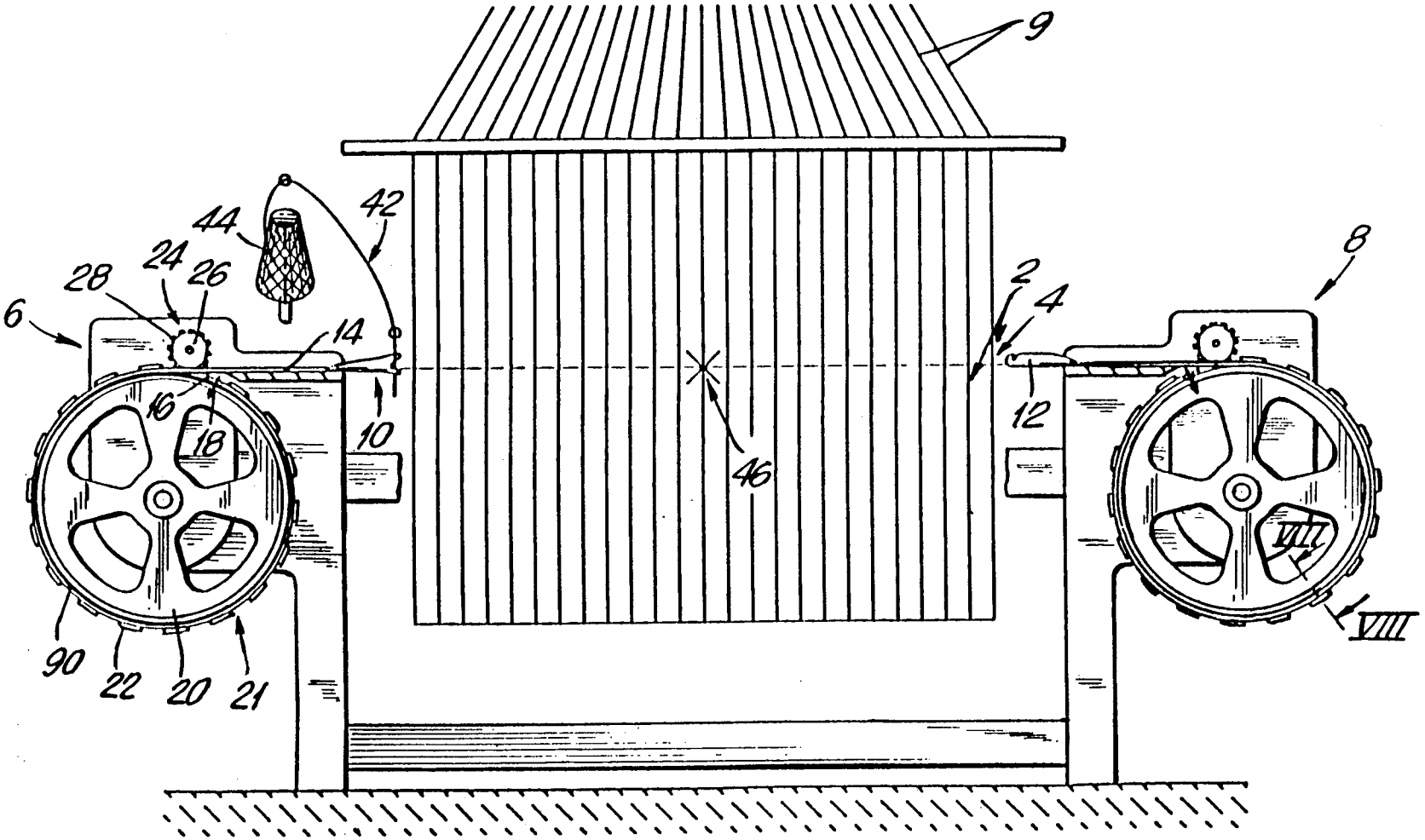

This is a continuation application of Ser. No. 07/295,608, filed Nov. 30, 1988 now abandoned.

The invention is directed to a gripper loom according to the preamble of the claim 1.

Gripper looms of the above-mentioned type are variously known. Thus, the EP-PS 0 126 497, for instance, describes such a gripper loom, in which the insertion band is in engagement with a drive wheel across a portion of its circumference, wherein at the start as well as at the end of the insertion one each block-shaped drive member holds the insertion band at the circumference of the drive wheel. The band end facing away from the gripper head is guided in a guide channel. It is very disadvantageous that the block-shaped guide members are subjected to considerable heating and great wear due to friction, which has detrimental consequences upon the work precision and the down times. The friction of the band end facing away from the gripper head in the guide channel also leads on the one hand to wear and, on the other hand, to a force exertion for pushing the insertion band into the guide channel, whereby the lifting of the insertion band off the circumference of the drive roller is promoted. Other guide members are also known. Thus, for instance, from EP 0 095 137, a guide band, which is arranged along the entire region of the engagement of the insertion band at the drive wheel and which presses the insertion band against the circumference of the drive wheel. This device is relatively complicated and requires a relatively high driving force because of the numerous guide and reversing rollers of the guide band.

Gripper looms are also known which operate with unperforated insertion bands. Thus such a gripper loom is known, for instance, from CH-PS 652,764 in which the band end facing away from the gripper end is rigidly connected with a drive wheel, wherein an unperforated insertion band is used, so that the force introduction occurs through the band end and the band can be wound in one single or several layers on the drive wheel. In order to prevent the lift-off of the insertion band from the drive wheel, which occurs as a consequence of the drive force introduced at the band end and/or as a consequence of centrifugal force, a complicated guide apparatus is provided containing a cable, whose both ends are fastened at the drive wheel and which is slung around the drive wheel in a multiple manner and is additionally guided by rollers arranged externally of the drive wheel. These rollers serve on the one hand for tightening or stretching the rope and, on the other hand, for reversing the rope from one guide region at the circumference of the drive wheel to the upper side of the insertion band wound around the drive wheel. This guide apparatus is extraordinarily complicated and requires additional drive forces in order to maintain the insertion band at the drive wheel and because of the circuitous guidance and reversal of the cable. An increase of the rpm, meaning of the output of the grippers, is therefore not possible. If the insertion band is wound up in two layers, it is additionally necessary that it contain spacer strips in order to insure intermediate space for the guide cable between the individual layers of the insertion band.

The rpms of these known looms are limited to 400 to 600 revolutions per minute because of these described problems.

It is the task of the invention to design a gripper loom of the type described above in such a way that an increase in rpm to, for example, 1,000 rpm, is possible and that herein a simple guidance of the insertion band is still provided, which is subject to only low wear and requires only low drive forces and which absorbs the centrifugal forces.

The thus defined task is solved by the invention by the characteristic features of claim 1. Because the insertion band is designed to be perforated and is driven by a toothed drive wheel in circumferential direction so that the force introduction is introduced essentially in the direction of motion of the gripper head and because the band end facing away from the gripper head is fastened at a rotary guide apparatus, the frictional forces required for the guide channels are eliminated, which is not only favorable for a careful treatment of the insertion band, but rather also prevents the insertion band from lifting off the circumference of the drive wheel. This is particularly true also when, for instance, the drive of the guide apparatus is coupled with the drive wheel, so that the drive wheel needs not to exert any tensile or compressive forces for the segment of the insertion band facing away from the gripper head. The drive and the guidance of the insertion band is nearly friction-free, because the driving force and the centrifugal force are carried by the toothed engagement in circumferential direction of insertion band and drive wheel, and by the insertion band fastened with the rotating guidance apparatus, thus causing no wear, which is particularly favorable for the accuracy and high useful life of the gripper loom. The low frictional forces reduce the required drive forces. A reduction of the drive forces is also favored by the small moving masses. All this leads, in the end effect, to the circumstance that considerably higher speeds, up to 1,000 rpm, are possible and this practically without wear which is equivalent to quiet operation, increased useful life of the gripper loom and low vibration.

The design of the gripper loom according to claim 4 is particularly expedient since the drive wheel and with it the inertia forces can be kept small.

Especially if the guidance apparatus is arranged independently of the drive wheel, an additional guide member according to claim 5 is advisable.

If the drive of the guide apparatus is not expediently coupled with the drive wheel, but rather is to be actuated by the insertion band, a design according to claim 6 is required.

Particularly expedient is a design of the gripper loom according to claim 7, since then a guidance apparatus independent of the drive wheel is not necessary. In order to keep the drive wheel as small as possible and thus its inertia as low as possible, a design according to claim 8 is expedient.

The guide member which is assigned to the drive wheel on the side of the gripper head can be designed as a sliding guide according to claim 9. However, a design according to claim 10 is advantageous, whereby the friction between insertion band and guide wheel is eliminated. An improvement of the drive between the drive wheel and the insertion band can be achieved by coupling the drives of the drive wheel and the guide wheel with each other, wherein the guide wheel can then serve simultaneously also for assisting the drive. These properties are further improved by a design of the guide wheel according to claim 11. Herein the guide wheel can cooperate with the perforation of the insertion band provided for engagement with the drive wheel. A design according to claim 12 is, however, more advantageous because then a more subtle cooperation between the guide wheel and the insertion band exists. The guide properties of the guide member can be improved by a design according to claim 13 and/or 14.

According to claim 20 the gripper loom can be equipped with one single filling thread insertion device, which is effective from side of the shed throughout the entire shed . However, a design known as such according to claim 15 is more advantageous. Herein the gripper heads can traverse an equally long travel path according to claim 16, or also paths of different lengths according to claim 17. Furthermore, it is possible to insert the gripper heads synchronously from both sides into the shed or this can also be done in a dephased manner. Herein it is even possible that the gripper head which pulls the filling thread into the shed is already again in the course of its return motion, when the other gripper head takes the filling thread over. According to claim 18, it is also possible to insert a filling thread from each side of the shed, which threads are preferably connected to each other according to claim 19.

A refinement according to claim 21 is especially advantageous wherein, to be sure, protection is claimed for the features of claim 21 also independently of the features of the previous claims 1-20, because the friction reducing and cooling effect of the compressed air supply to the sliding guide is advantageous also for other gripper looms.

The compressed air can herein simultaneously press the insertion band against the drive wheel, which counteracts the centrifugal force of the driven insertion band and thus assures a secure retention of the insertion band at the drive wheel. Expedient designs are described in claims 22-27.

The sliding guide can be limited to the region facing the gripper head, at which the insertion band leaves the drive wheel. A design in accordance with claim 22 is also expedient, which assures a secure retention of the insertion band at the drive wheel. Since an air cushion reducing the friction is formed by the compressed air, such a guide member according to claim 23 can be expediently arranged along the entire region, at which the insertion band rests at the drive wheel. This assures a secure retention of the insertion band at the drive wheel, wherein the compressed air can be preferably adjusted in such a way that the insertion band rests at the drive wheel in spite of the centrifugal force.

The insertion band can be a smooth, continuous band; however, a perforated insertion band is advantageous wherein then a design according to claim 24 is particularly advantageous and takes care of a secure contact of the insertion band at the drive wheel.

Particularly advantageous is also a design according to claim 25, whereby the guidance of the gripper head and of the insertion band at the shed is improved. So that the inserted filling thread is not blown away by the compressed air, a design according to claim 26 is expedient.

Particularly useful is also a design according to claim 27, since then the supply of compressed air can be adjusted at the individual consumption points in accordance with the individual requirements.

Figure 2:
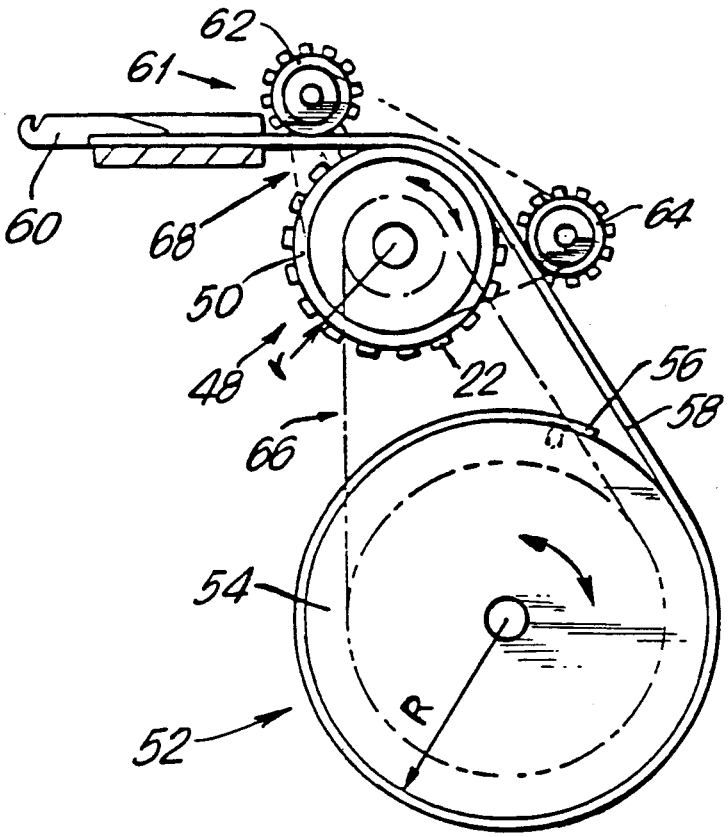
Figure 3:
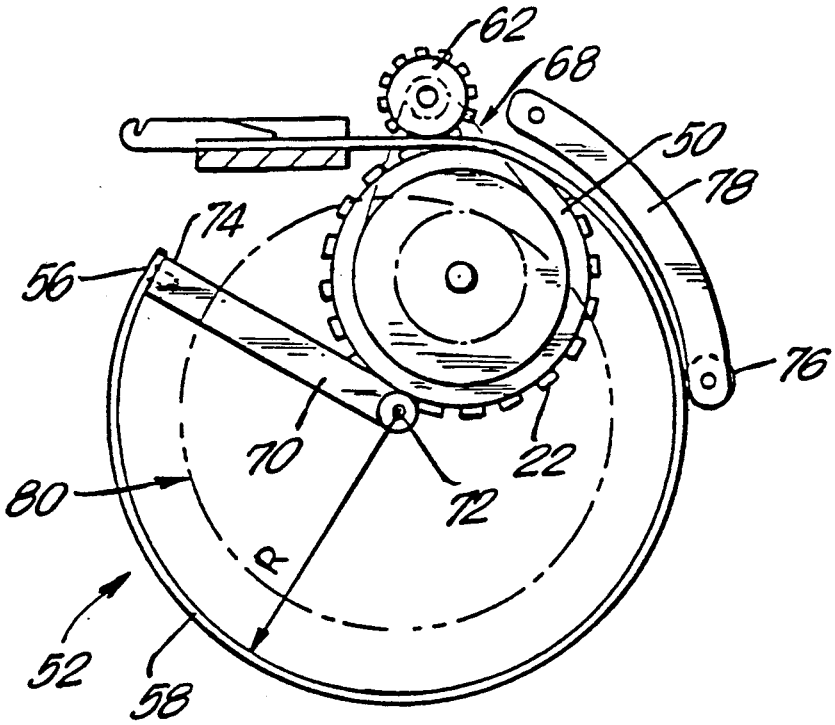
Figure 4:
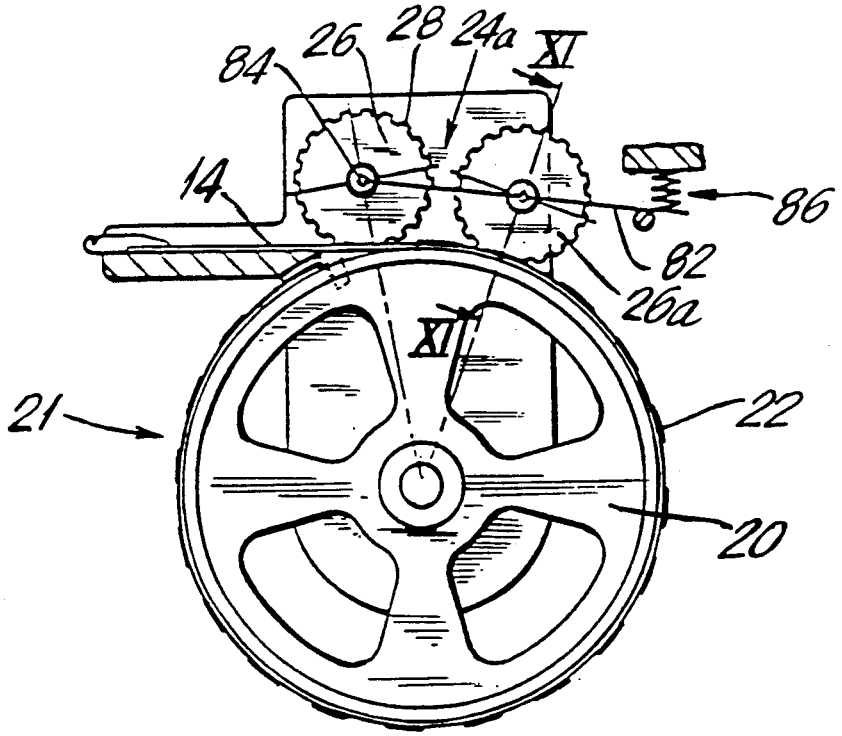
Figure 5:
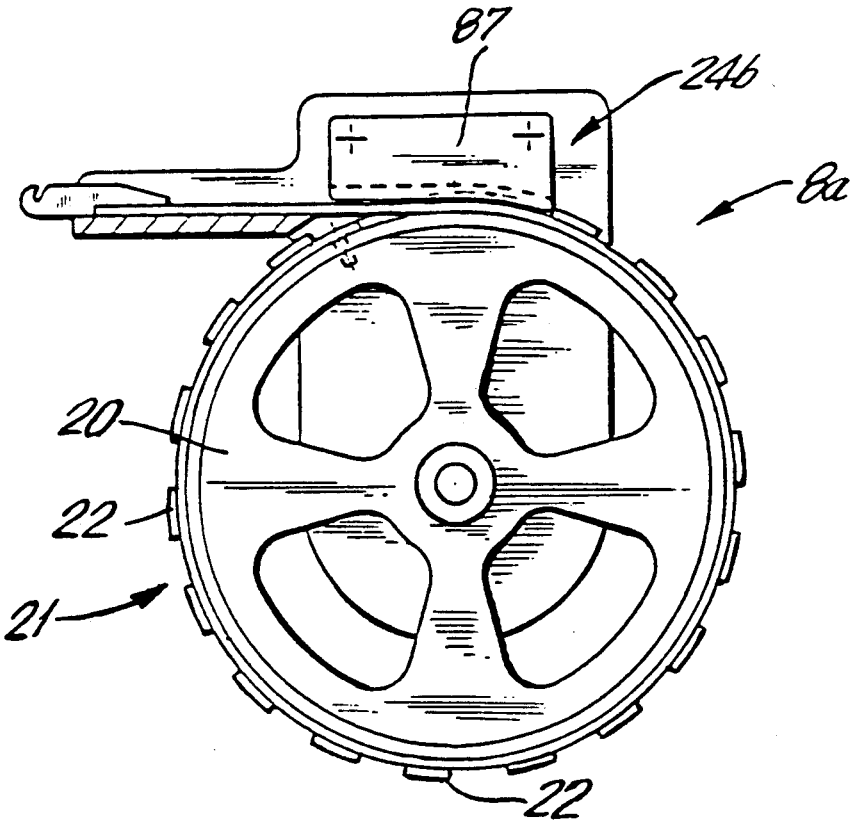
Figure 6:
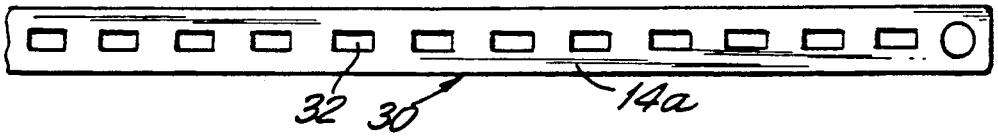
Figure 7:
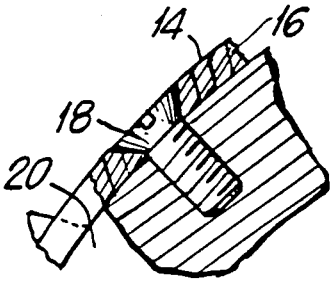
Figure 8:
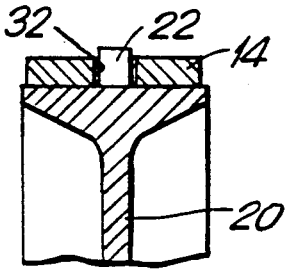
Figure 10:
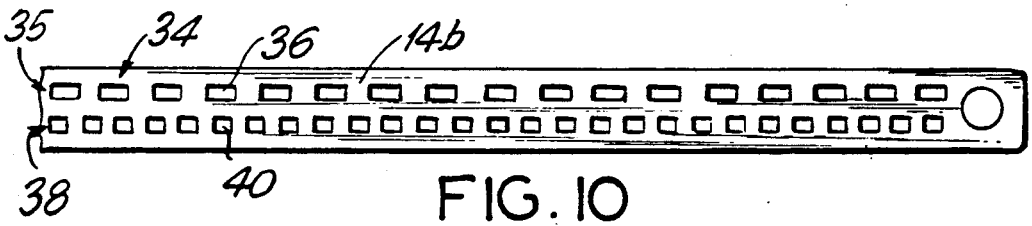
Figure 11:
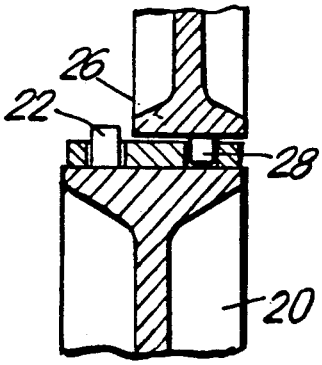
Figure 9:
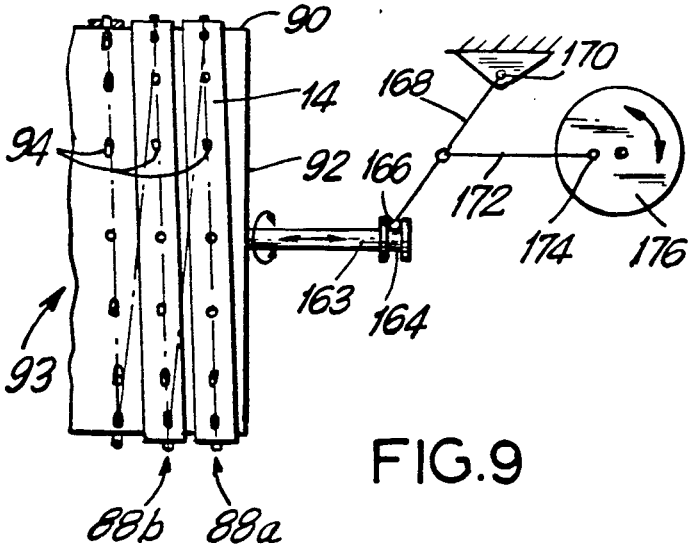
Figure 12:
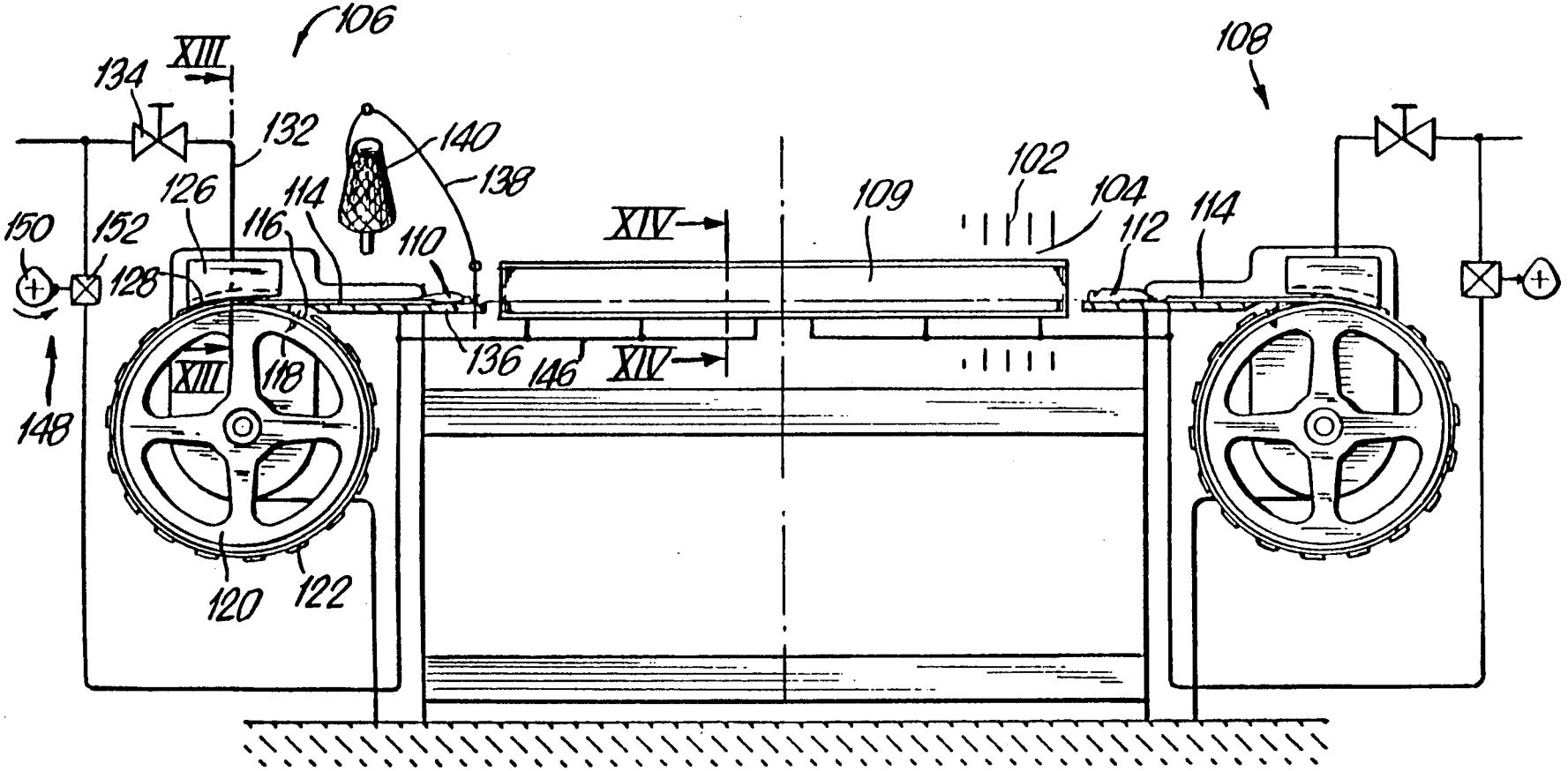
Figure 13:
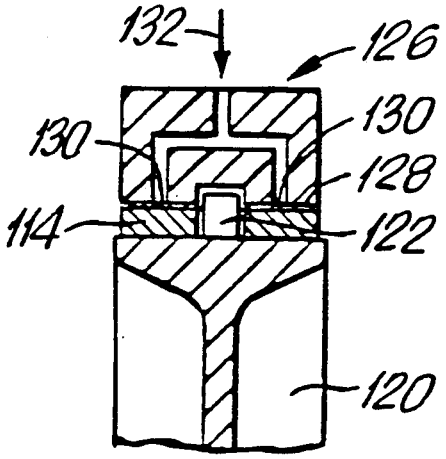
Figure 14:
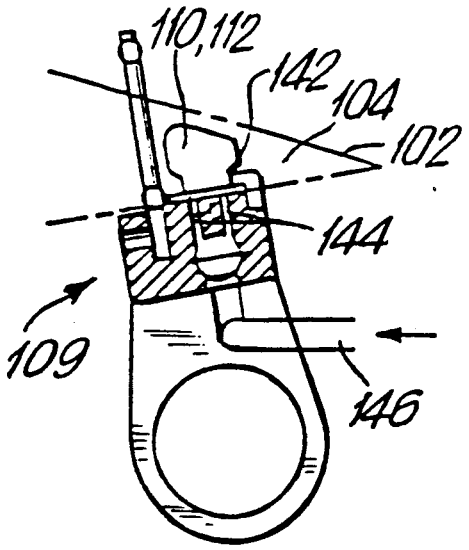

Embodiment examples of the gripper loom are described in the following with particularity, with help of diagrammatic drawings. It is shown on:

FIG. 1 a first gripper loom in front view perpendicularly to the direction of the cloth against the filling thread insertion devices, in diagrammatic illustration;

FIG. 2 a filling thread insertion device of a second type in diagrammatic illustration;

FIG. 3 a filling thread insertion device of a third type in diagrammatic illustration;

FIG. 4 a filling thread insertion device of a fourth type in diagrammatic illustration;

FIG. 5 a filling thread insertion device of a fifth type in diagrammatic presentation;

FIG. 6 a first insertion band, by way of a cut-out and in plan view;

FIG. 7 a cut-out of the fastening of the band end of the insertion band;

FIG. 8 a drive wheel with insertion band resting thereon, partially in section VIII—VIII of FIG. 1 and by way of a cut-out;

FIG. 9 a further variant of the drive wheel with helically wound insertion band in vertical section and in a cut-out;

FIG. 10 a further insertion band with two rows of perforations by way of a cut-out and in plan view;

FIG. 11 the cooperation of drive wheel, insertion band according to FIG. 10 and guide wheel, in partial section XI-XI of FIG. 4 and in a cut-out;

FIG. 12 a second gripper loom with two filling thread insertion devices in front view transversely to the extent of the cloth;

FIG. 13 the guide member at the drive wheel along the section XIII—XIII of FIG. 12;

FIG. 14 the weaving reed in section XIV—XIV of FIG. 12; and

Figure 15:
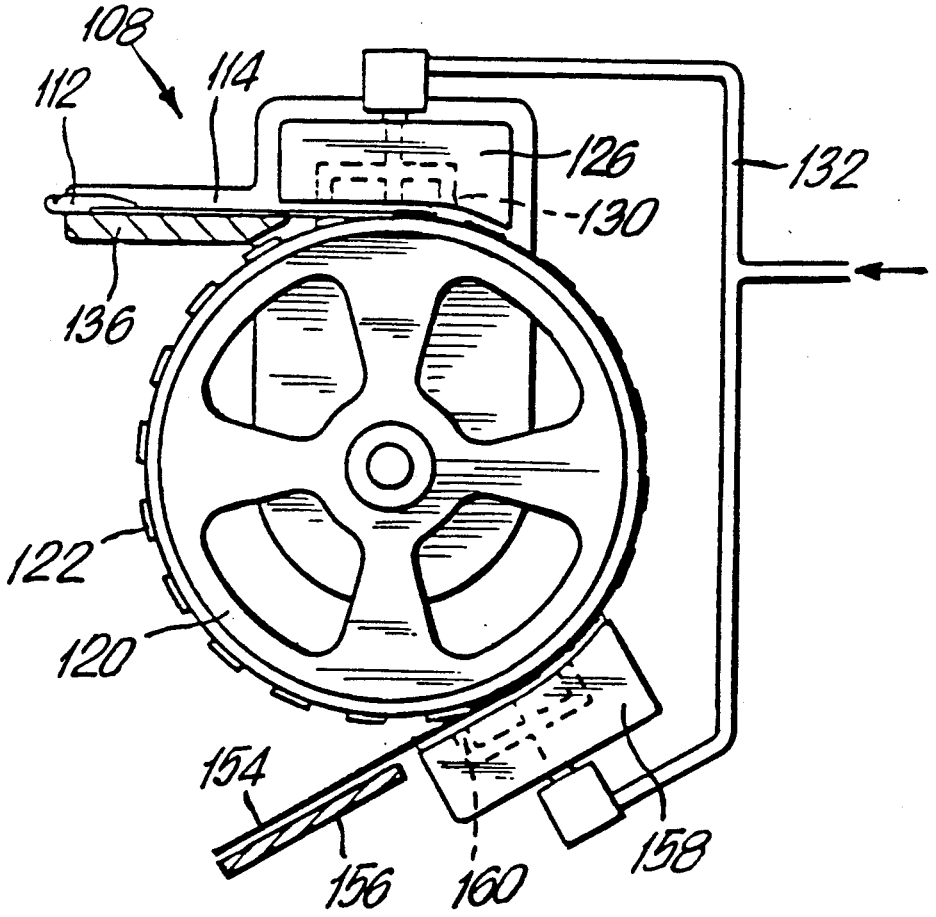

FIG. 15 a further embodiment of guide members at the drive wheel.

FIG. 1 shows the parts of a gripper loom essential for the present invention, where filling thread insertion devices 6,8 are arranged on both sides of a shed 4 formed by warp threads 2. The shed is formed in a known manner by non-depicted shedding machines as, for instance, an electronically controlled Jacquard machine by harness cords 9 and heddles. These filling thread insertion devices 6,8 have an identical construction with exception of modified gripper heads 10,12. The filling thread insertion devices 6,8 contain respectively one perforated flexible insertion band 14, at whose one band end the gripper head 10 or 12 is fastened and whose other band end 16 is fastened at an alternatingly driven drive wheel 20, for instance by means of a screw 18. The drive wheel 20 thus serves simultaneously as guide apparatus 21 for the band end 16 and moves same during the entire working stroke along a circularly shaped guide path.

The drive wheel 20 comprises teeth 22 arranged to be distributed along its circumference, which engage into holes of the perforated flexible insertion band 14, as is depicted in detail in FIG. 8. Such an insertion band can be designed for instance according to FIGS. 6 and 10, as is described in more detail in the following. A guide member 24 is assigned to the drive wheel 20, which is constructed as a sliding guide or as depicted as a guide wheel 26, which is also provided with teeth 28 at its circumference. The guide wheel engages into that region of the insertion band 14 which is assigned to the gripper head 10 or 12 and ensures that the insertion band 14 is in close engagement with the drive wheel 20 and does not lift off during the driving period.

The teeth 28 of the guide wheel 26 can be of the same size as the teeth 22 of the drive wheel 20 and can engage into the same holes, into which engage also the teeth 22 of the drive wheel 20, so that for instance an insertion band a according to FIG. 6 can be used, which has a perforation with holes 32 of the same size. In the present example, the guide wheel 26, however, has teeth 28 which are smaller than the teeth 22 of the drive wheel 20 and, in this case, an insertion band 14*b* as shown in FIG. 10 is required. Such an insertion band has a perforation 34 with a first row 35 with holes 36 which are intended for the teeth 22 of the drive wheel 20, and a second row 38 with holes 40 whose size and spacing can be smaller than that of the holes 36 in the first row 34 and which are intended for engagement with the teeth of the guide wheel 26.

In the gripper loom in FIG. 1, the left filling thread insertion device 6 comprises a gripper head 10 which is constructed to be fork-shaped and serves for gripping one filling thread 42 which is, for instance, drawn off a supply cone 44. The gripper head 12 of the right-hand side filling thread insertion device 8 is designed to be hook-shaped and serves for taking over the filling thread made available by the gripper head 10. The filling thread insertion devices are constructed in such a way that the gripper heads 10,12 are moved synchronously counter to each other and cover respectively half the length of the thread 4 up to the transfer point 46, at which the gripper head 12 grips the filling thread 42 from the gripper head 10 and pulls same further through the shed up to the other side of said gripper head 10. In the present example, both filling thread insertion devices 6,8 are constructed identically and their gripper heads 10,12 sweep respectively in the course of their working stroke half the width of the shed 4. It is, however, entirely possible for both filling thread insertion devices to have different working strokes, so that the transfer region can be shifted leftward or rightward in the shed. It is furthermore possible that the movement sequences do not occur synchronously counter to each other; rather, with a phase shift, when for instance one of the gripper heads reaches the transfer region 46 before the other one. It is even possible to construct the filling thread insertion devices in such a way, that the gripper head 10 for instance already performs the return movement and is overtaken in the course of this by the gripper head 12. Furthermore, it is possible that the filling thread insertion devices are designed differently and operate according to another principle, so that, for instance, the right-hand side filling thread insertion device 8 in FIG. 1 can be constructed according to that of the Swiss Patent Application 3 644/86-7.

FIG. 2 shows another filling thread insertion device 48 where a guidance apparatus 52 in the form of a guide wheel 54 with a radius R is assigned to a toothed drive wheel 50 with a radius r, wherein R is bigger than r, at which guide wheel the band end 56 of an insertion band 58 is fastened and is being wound up in a circularly-shaped guide path. At the side of the gripper head 60 the insertion band 58 is again led towards the drive wheel 50 by a toothed or non-toothed guide wheel 62 serving as a guide member 61. Between the drive wheel 50 and the guide wheel 54 an additional guide wheel 64 contacts the insertion band 58 at the outlet or inlet region of the drive wheel 50. The guide wheels 54,62,64 can be free wheeling and be moved only by the insertion band 58 driven by the drive wheel 50. It is however also possible for the drive wheel 50 to drive the guide wheel 54 as this is indicated by the sprocket wheel belt drive 66 depicted in broken dotted lines. The guide wheels 62,64 can be driven also by a corresponding sprocket wheel belt drive 68.

FIG. 3 shows another embodiment example of a filling thread insertion device, which is structured similarly to that in FIG. 2, so that identical parts are provided with the same designation numbers. Instead of the guide wheel 54 in FIG. 2, a guide arm 70 with a length or the radius R is assigned to the guide wheel 50 in the embodiment example in FIG. 3, which is fastened with one end at the shaft 72 and which carries at its other end 74 the band end 5 of the insertion band 58 along a circularly shaped guide path with radius R. A guide roller 76 is located downstream of the drive wheel 50, which is fastened at a support arm 78. The guide arm 70 could also be driven synchronously with the drive wheel 50 by a gear wheel unit 80 indicated in broken dotted lines. Correspondingly, the guide wheel 62 can be synchronously actuated by a sprocket wheel belt drive 68 indicated in broken dotted lines.

FIG. 4 shows an additional filling thread insertion device, which is constructed analogously to the filling thread insertion device 8 in FIG. 1, so that again identical parts have been given identical reference numbers and reference is made to the statements in connection with FIG. 1. As far as the description of FIG. 4 is concerned, a second drive wheel 26*a* is assigned to the guidance member 24*a* for guiding the insertion band 14 at the drive wheel 20 in addition to the first guide wheel 26, which guide wheels are located on both sides of the inlet point of the insertion band 14 to the drive wheel 20. The second guide wheel 26*a* is supported at a rocker 82, which is swivelably supported around the axis 84 of the guide wheel 26 and is biased by means of a spring 86 against the insertion band 14 or the drive wheel 20.

FIG. 5 shows the right hand filling thread insertion device 81 of FIG. 1 wherein, however, the guide member 24*b* is constructed not as a guide wheel but as a sliding guide 87.

FIG. 6 shows the insertion band 14*a* which has already been described previously, with a perforation 30 formed by the row of holes 32. The insertion band 14*a* can be fastened to the drive wheel 20 or to another guidance apparatus by means of the screw 18, as has also already been mentioned and shown in FIG. 7. The insertion band can, however, be also connected with the drive wheel or the guidance apparatus by means of an adhesive connection or in another suitable manner, this instead of the threaded connection.

As is shown in FIG. 9, the insertion band 14 can be wound in at least two rows 88*a*,88*b* helically around the circumference 90 of a drive wheel 92, which simultaneously serves as a guidance apparatus 93 for the band end. For this purpose, the drive wheel 92 is equipped with teeth 94 arranged along a helical path. In order that the insertion band always unrolls in an aligned position with respect to the shed, it can be expedient to arrange the drive wheel so as to be able to reciprocate in axial direction to correspond with the pitch of the helical path of the teeth 94.

To provide the reciprocating action, a drive shaft 163 is provided which has a groove-like guidance 164 into which claws 166 at one end of a rocking lever 168 engage. The rocking lever 168 is arranged at its other end so as to be pivotable at a joint 170. The rocking lever 168 is connected with an eccentric 174 of a drive wheel 176 by a coupling rod 172.

The drive wheel 20 and the guide wheel 26,26*a* can comprise teeth 22 or 28 which have different sizes and spacings and co-act with separate rows 35,38 consisting of holes 36,40 of corresponding size in the insertion band 14*b*; this has already been mentioned in connection with the embodiment example of FIGS. 1 and 4 and can be discerned in detail from FIGS. 10 and 11.

FIG. 12 shows again the parts of a gripper loom essential for the present invention, where filling thread insertion devices 106,108 are arranged on both sides of a shed 104 formed by the warp threads 102. The weaving reed is constituted in a manner known as such by a shedding arrangement which has therefore not been depicted here. The weaving reed 109 is arranged in the shed for the setting of an inserted filling thread. The filling thread insertion devices 106,108 have an identical construction with exception of modified gripper heads 110,112.

The filling thread insertion devices 106,108 contain respectively a perforated flexible insertion band 114 at whose one end the gripper head 110 or 112 is fastened and whose other end is fastened at an alternatingly driven drive wheel 120, for instance by means of a screw 118. The drive wheel 120 comprises teeth 122 arranged to be distributed at its circumference, which engage into holes 124 of the perforated flexible insertion band 114 as is shown in detail in FIG. 13. A guide member 126 is assigned to the guide wheel 120 which is designed as a sliding guide.

The guide member 106 especially depicted in detail in FIG. 13 contains a slideway 128, in which compressed air outlet apertures 130 are arranged, which are directed against the insertion band 114. Respectively one row of such compressed air outlet apertures 130 exists on each side of the teeth 122. The compressed air outlet apertures are connected with a source of compressed air, which is not depicted here, by means of a feed line 132. A control valve 134 is arranged in the feed line 132 permitting adjustment of the supply of compressed air to the guide member 126.

The gripper head 110 rests on a guide 136 in order to grip a thread 138 from a supply coil 140 and insert same into the shed 104. The gripper head 110 conveys the thread 138 approximately to the center of the shed, where it is taken over by the gripper head 112 of the second filling thread insertion device 108 and is pulled out of the shed to the other side. The gripper heads 110 and 112 are guided on a guide 142 along the path through the shed, which guide is arranged at the weaving reed 109 as can be particularly discerned from FIG. 14.

The stationary guide 136 and the guide 142 at the weaving reed 109 again contain compressed air outlet apertures 144, in order to reduce the friction of the gripper head and the insertion band at their introduction into the shed. The compressed air outlet apertures 144 are again connected with a source of compressed air, not depicted here, by a feed line 146. A control apparatus 148 exists in feed line 146 which contains a rotating cam disc 150 actuating a valve 152. The supply of compressed air can be shut off in the phase of the weaving process by the control apparatus 48, during which phase the weaving reed 109 sets up the inserted filling thread at the fabric.

FIG. 15 shows another embodiment example where the end of the insertion band 114 is not fastened to the drive wheel 120, rather the insertion band is guided only over a portion of the circumference of the guide wheel. The portion 54 of the insertion band 114 facing away from the gripper head 112 leaves the drive wheel 120 and is guided in an additional guide 156. An additional guide member 158 is arranged at the separation point of the portion 154, which guide is constructed analogously to the guide member 126, which engages at the drive wheel 120 on the side facing the gripper head 112. The guide member 158 contains also compressed air outlet apertures 160, which are facing the insertion band 114 and are connected with a source of compressed air by a feed line 162. Instead of the depicted embodiment forms, the two guide members 126,158 can be designed in one piece extending across the entire wraparound region of the insertion band 114 at the drive wheel 120.

The insertion bands of the gripper looms can be designed in varying manner. For instance, they can consist of metal. Bands made out of plastic material, for instance polyester, are especially advantageous, which bands are reinforced by fibers preferably carbon fibers and/or glass fibers. The insertion band is coated on both sides with fluoroplastic, meaning teflon, in order to reduce the friction.

We claim:

1. A gripper loom with at least one filling thread insertion device, comprising a perforated flexible insertion band (14, 14*a*, 14*b*, 58 114), which carries a gripper head (10, 12, 60, 110, 112) at one end and which is advanced into and again retracted from a shed by means of an alternatingly driven drive wheel, wherein the drive wheel comprises teeth distributed across the circumference which engage into perforations (30, 34, 124) of the insertion band, wherein furthermore a guide member (24, 24*a*, 25*b*, 61, 87, 126) is assigned to the drive wheel near the gripper head so as to prevent the insertion band from lifting off the circumference of the drive wheel, an end (56) of the band facing away from the gripper head (10, 12, 60, 110, 112) being fastened at a rotary guidance apparatus (52) arranged with respect to the drive wheel so that the band end (56) describes an at least approximate circular guide path during an entire reciprocating motion thereof, the radius (R) of said path being larger than the radius (r) of the drive wheel (50).

2. A gripper loom according to claim 1, wherein the guide apparatus (52) comprises a guide wheel (54) which is coupled with the drive wheel (50) for drive purposes, as well as means for coupling the guide wheel (54) with the drive wheel (50).

3. A gripper loom according to claim 1, wherein the guide apparatus (52) comprises a guide arm (70), at one end (70) of which the band end (56) is fastened and whose other end is supported to be rotatable around a shaft (72), arranged parallel to the axis of the drive wheel (50), and further comprising means for coupling the guide arm (70) with the drive wheel (50) for drive purposes.

4. A gripper loom according to claim 1, wherein an additional guide member (64) for the insertion band (58) exists in the guide apparatus (52), between the guide apparatus 52 and the drive wheel (50).

5. A gripper loom according to claim 1, wherein the insertion band (58) is constructed to be so stiff in bending that it drives the guide apparatus (52) located downstream of the drive wheel (50).

6. A gripper loom according to claim 1, wherein the guide member (24*b*, 126) is constructed as a sliding guide (87, 128) and consists of a material which slides easily and is prone to wear.

7. A gripper loom according to claim 1, wherein the guide member (24, 24*a*, 61) is constructed as a guide wheel (26, 26*a*, 62), and further comprising means for coupling the guide wheel with the drive wheel (20, 50) for drive purposes.

8. A gripper loom according to claim 7 wherein the guide wheel (26, 26*a*, 62) is provided with teeth (28) along the circumference which coact with the insertion band (14, 14*a*, 14*b*).

9. A gripper loom according to claim 8 wherein the perforations in the insertion band (14*b*) comprises at least a row (28) of holes (40) for engagement of the teeth (28) of the guide wheel (26), wherein the spacing and the size of the holes (40) of the row (38) is preferably smaller than the spacing and the size of the holes (36) of another row (35).

10. A gripper loom according to claim 1 wherein that the guide member (24*a*) is biased by means of a spring (86) against the insertion band (14).

11. A gripper loom according to claim 1, wherein two guide members (26, 26*a*, 126, 158) are arranged on each side of a contact region of the insertion band (14, 114) at the drive wheel (20, 120).

12. A gripper loom according to claim 1, and further comprising a filling thread insertion device (6, 8) on each side of the shed (4), the insertion devices having gripper heads (10, 12) arranged so as to traverse respectively one portion of the width of the shed while acting counter to each other, so that the filling thread (42) pulled into the shed by one gripper head (10) can be taken over by the other gripper head (12) and pulled completely through the shed (4).

13. A gripper loom according to claim 1, wherein the gripper heads (10, 12, 110, 112) are arranged so as to traverse the respective one portion of the shed width with approximately equal working strokes.

14. A gripper loom according to claim 1, wherein the gripper heads (10, 12, 110, 112) have working strokes of different length.

15. A gripper loom according to claim 1, and further comprising a filling thread insertion device (6) on each side of the shed (4), having gripper heads (10) arranged so as to act oppositely against each other and traverse a corresponding portion of the shed, so that a left-hand side and right-hand side gripper insert one filling thread each so as to form two fabric segments.

16. A gripper loom according to claim 1, wherein the filling threads have tips are connected with each other in such a way that a fabric is formed.

17. A gripper loom according to claim 1, wherein the gripper head of the filling thread insertion device is provided so as to traverse the entire width of the shed and pull the filling thread completely across the entire fabric width.

18. A gripper loom according to claim 1, wherein the insertion band (14, 114) is a fiber-reinforced plastic band, coated on both sides with fluorocarbon plastic (teflon).

19. A gripper loom according to claim 18, characterized wherein the insertion band (14, 114) consists of polyester containing carbon fibers and/or glass fibers.

20. A gripper loom according to claim 1, wherein the guide apparatus (52) comprises a guide wheel (54) which is arranged so as to be directly driveable by the reciprocating insertion band.

21. A gripper loom according to claim 1, wherein the guide apparatus (52) comprises a guide arm (70) arranged parallel to the axis of the drive wheel (50) and having one end at which the band end (56) is fastened and whose other end is supported to be rotatable around a shaft (72), said guide arm (70) being provided so as to be directly driveable by said reciprocating insertion band.

22. A gripper loom with at least one filling thread insertion device, comprising a perforated flexible insertion band (14, 14*a*, 114), which carries a gripper head (10, 12, 110, 112) at one band end and is fastened at the other band end at a circumference of an alternatively driven drive wheel (20, 92, 120) and is advanced into and retracted again from a shed (4, 104), wherein the drive wheel comprises teeth (22, 94, 122) distributed at the circumference so as to engage into perforations (30, 124) of the insertion band, a guide member (24, 24*a*, 24*b*, 126) being assigned to the drive wheel on a side of the gripper head so as to prevent the insertion band from lifting off the circumference of the drive wheel, the drive wheel (92) having at its circumference at least two rows (88*a* 88*b*) of teeth (94) arranged along a helical path so as to wind the insertion band (14*a*) in a helical manner.

23. A gripper loom according to claim 22, wherein the drive wheel (92) is arranged so as to be reciprocatable in an axial direction corresponding to the pitch of the helical path.

24. A gripper loom with at least one filling thread insertion device, comprising a perforated flexible insertion band (14, 14*a*, 14*b*, 58, 114), which carries a gripper head (10, 12, 60, 110, 112) at one end and is advanced into and retracted from a shed (4, 104) by an alternatively driven drive wheel (20, 50, 92, 120), the drive wheel having teeth (22, 94, 122) distributed on the drive wheel circumference so as to engage into perforations (30, 34, 124) of the insertion band, guide means including a rotary guide member (21, 52, 93, 120) being assigned to the drive wheel near the gripper head for preventing the insertion band from lifting off the circumference of the drive wheel, an end of the band facing away from the gripper being fastened at the rotary guide member, the guide means further including at least two rows of teeth arranged at the circumference of the drive wheel so as to form a helical path so that the insertion band is wound in a helical manner.

25. A gripper loom with at least one filling thread insertion device (106, 108), comprising a flexible insertion band (114) driven by a drive wheel (120) which insertion band (114) carries a gripper head (110, 112) at one band end, and further having at least one guide member (126) for the insertion band (114), which guide member (126) is formed as a slideway having a glide path (128) in which outlet apertures (130) for compressed air pointing against the insertion band (114) are arranged, which are connected with a source of compressed air, an additional guide member (158) with a slideway and with compressed air outlet apertures (160) pointing against the insertion band (114) is arranged at a side of the drive wheel (120) away from the gripper head (112).

26. A gripper loom according to claim 1, and further comprising individual compressed air feed lines (132) connected to the compressed air source, and means (134) for adjusting a supply of compressed air from the compressed air source, said adjusting means being arranged at least in the individual compressed air feed lines (132).

27. A gripper loom with at least one filling thread insertion device (106, 108) comprising a flexible insertion band (114) driven by a drive wheel (120) which insertion band (114) carries a gripper head (110, 112) at one band end, and further having at least one guide member (126) for the insertion band (114), which guide member (126) is formed as a slideway having a glide path (128), in which outlet apertures (130) for compressed air pointing against the insertion band (114) are arranged, which are connected with a source of compressed air, the guide member (126, 158) with the slideway (128) and compressed air outlet apertures (130, 160) being arranged along an entire region where the insertion band (114) rests against the drive wheel (120).

28. A gripper loom with at least one filling thread insertion device, comprising a flexible insertion band (114) driven by a drive wheel (120) which insertion band (114) carries a gripper head (110, 112) at one band end, and further having at least one guide member (126) for the insertion band (114), which guide member (126) is formed as a slideway having a glide path (128) in which outlet apertures (130) for compressed air pointing against the insertion band (114) are arranged, which are connected with a source of compressed air, the insertion band (114) having a row of perforations which cooperate with teeth (122) on the drive wheel (120), the compressed air outlet apertures (130, 160) being arranged on both sides of the row of perforations.

29. A gripper loom with at least one filling thread insertion device (106, 108), comprising a flexible insertion band (114) driven into and out of a shed (104) by a drive wheel (120), which insertion band (114) carries a gripper head (110, 112) at one band end, and further having at least one guide member (126) for the insertion band (114), which guide member (126) is formed as a slideway having a glide path (128) in which outlet apertures (130) for compressed air pointing against the insertion band are arranged, which are connected with a source of compressed air, the gripper head (110, 112) and the insertion band (114) being guided in the region of the shed (104) on a guide (142) arranged as part of a weaving reed (109), the guide (142) comprising additional compressed air outlet apertures (144) pointing against the insertion band (114) and the gripper head (110, 112).

30. A gripper loom according to claim 29, wherein a control apparatus (148) is arranged in a compressed air feed line (146) assigned to the weaving reed (109), so as to interrupt supply of compressed air at least in a phase of setting an insertion thread.

* * * * *